United States Patent [19]

Goroza

[11] Patent Number: 5,031,344

[45] Date of Patent: Jul. 16, 1991

[54] MUSICAL PIN APPARATUS

[76] Inventor: Lillian V. Goroza, 94615 Kahakea St. #9-C, Waipahu, Hi. 96797

[21] Appl. No.: 564,122

[22] Filed: Aug. 8, 1990

[51] Int. Cl.[5] ..... A44C 3/00

[52] U.S. Cl. ..... 40/1.5; 24/303; 63/1.1

[58] Field of Search ..... 40/1.5, 1.6, 600, 621, 40/455, 407, 406; 63/DIG. 2, 20, 1.1, 2; 24/303, 265 B; 446/268, 137, 129; 239/6, 36, 54–60; 428/905, 906.6

[56] References Cited

U.S. PATENT DOCUMENTS

| | | | |
|---|---|---|---|
| 2,234,062 | 3/1941 | Roberts | 63/1.1 |
| 2,274,269 | 2/1942 | Jellinek | 63/1.1 |
| 3,197,166 | 7/1965 | Sandler | 24/303 X |
| 3,416,195 | 12/1968 | Borthwick | 24/303 X |
| 4,236,331 | 12/1980 | Mattson | 40/621 X |
| 4,531,310 | 7/1985 | Acson et al. | 40/455 X |

FOREIGN PATENT DOCUMENTS

| | | | |
|---|---|---|---|
| 7400818 | 7/1975 | Netherlands | 63/1.1 |

*Primary Examiner*—Kenneth J. Dorner
*Assistant Examiner*—J. Hakomaki
*Attorney, Agent, or Firm*—Leon Gilden

[57] ABSTRACT

Apparatus wherein a central housing body includes a fabric network in surrounding relationship thereto wherein the body includes an interior cavity wherein a musical IC module is actuatable by a central deformable dome permitting the pressing of an actuator ring in surrounding relationship relative to the body. The body includes a fastener mounted on a rear surface thereof with a ferro-magnetic cylinder selectively securable about elongate shank of the fastener. The deformable support tube receives a shank of a hook member which permits securement of various notes and the like onto the apparatus when mounted on a ferrous surface.

4 Claims, 4 Drawing Sheets

PRIOR ART

MUSICAL PIN APPARATUS

BACKGROUND OF THE INVENTION

1. Field of the Invention

The field of the invention relates to musical apparatus, and more particularly pertains to a new and improved musical pin apparatus wherein the sam provides selective securement to clothing and ferrous surfaces.

2. Description of the Prior Art

Various musical apparatus and in particularly musical apparatus utilizing integrated circuits (IC) are available but have heretofore failed to produce an organization to provide a jewelry like pin structure that may be selectively securable to a clothing garment or mounted to a ferrous surface to provide decorative and psychologically suiting structure for use by an individuals. Examples of the prior art organizations include U.S. Pat. No. 4,866,865 to YANG setting forth the use of integrated circuitry selectively actuatable when a name card is drawn out of an associated holder.

U.S. Pat. No. 3,798,806 to SANFORD sets forth a musical greeting card wherein a hinged card member includes a cavity mounting a musical box therewithin that is operative upon opening of the card.

U.S. Pat. No. 4,607,747 to STEINER provides for a packaging carton wherein an audible signal generator is actuated upon opening of the carton.

U.S. Pat. No. 4,607,747 to TARRANT sets forth a greeting card and music box organization that is actuated upon opening of the card structure.

As such, it may be appreciated that there continues to be a need for a new and improved musical pin apparatus as set forth by the instant invention which addresses both the problems of ease of use as well as effectiveness in construction in permitting selective securement to various support members as well as providing convenience of operation in use and in this respect, the present invention substantially fulfills this need.

SUMMARY OF THE INVENTION

In view of the foregoing disadvantages inherent in the known types of musical apparatus present in the prior art, the present invention provides a new and improved musical pin apparatus wherein the same provides an organization for selective securement to clothing as well as ferrous surfaces and permits enhanced use as a member to provide psychological and physical enjoyment to individuals by selectively employing a patch arrangement to contain odiferous material. As such, the general purpose of the present invention, which will be described subsequently in greater detail, is to provide a new and improved musical pin apparatus which has all the advantages of the prior art pin apparatus and none of the disadvantages.

To attain this, the musical pin apparatus of the invention includes apparatus wherein a central housing body includes a fabric network in surrounding relationship thereto wherein the body includes an interior cavity wherein a musical IC module is actuatable by a central deformable dome permitting the pressing of an actuator ring in surrounding relationship relative to the body. The body includes a fastener mounted on a rear surface thereof with a ferro-magnetic cylinder selectively securable about elongate shank of the fastener. The deformable support tube receives a shank of a hook member which permits securement of various notes and the like onto the apparatus when mounted on a ferrous surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved musical pin apparatus which has all the advantages of the prior art musical pin apparatus and none of the disadvantages.

It is another object of the present invention to provide a new and improved musical pin apparatus which may be easily and efficiently manufactured and marketed.

It is a further object of the present invention to provide a new and improved musical pin apparatus which is of a durable and reliable construction.

An even further object of the present invention is to provide a new and improved musical pin apparatus which is susceptible of a low cost of manufacture with regard to both materials and labor, and which accordingly is then susceptible of low prices of sale to the consuming public, thereby making such musical pin apparatus economically available to the buying public.

Still yet another object of the present invention is to provide a new and improved musical pin apparatus which provides in the apparatuses and methods of the prior art some of the advantages thereof, while simultaneously overcoming some of the disadvantages normally associated therewith.

Still another object of the present invention is to provide a new and improved musical pin apparatus which may be compactly stored when not being utilized.

Yet another object of the present invention is to provide a new and improved musical pin apparatus wherein the same sets forth an organization for selective and multiple use by individuals as an adornment structure for clothing or selectively as a mounting structure for use as a message retainer and air freshener.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
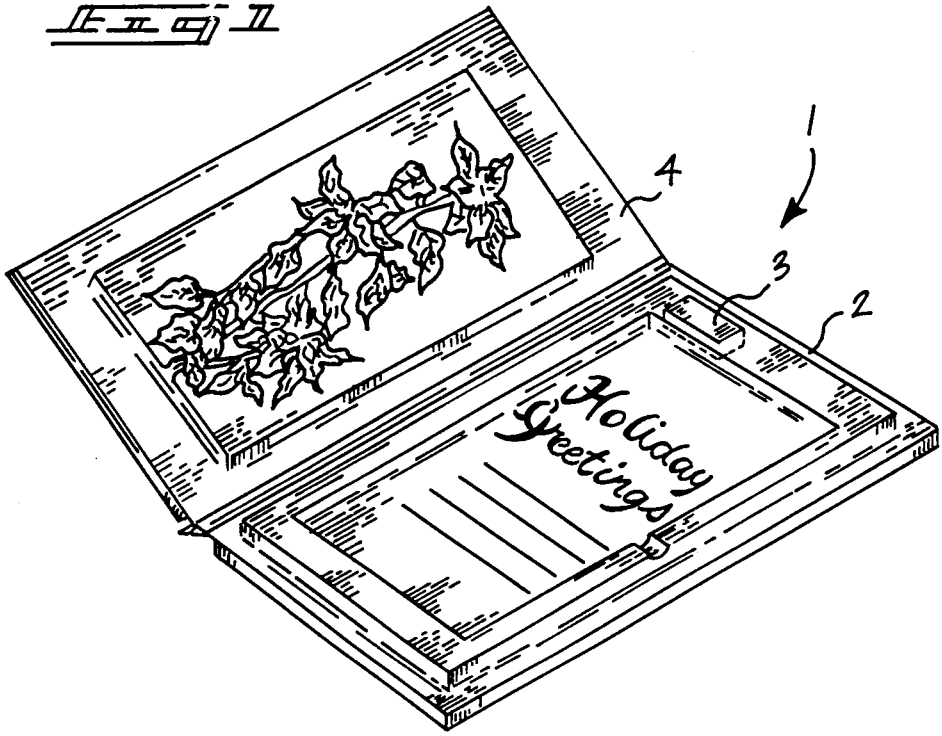
FIG. 1 is an isometric illustration of a prior art musical apparatus.

With reference now to the drawings, and in particular to FIGS. 1 to 8 thereof, a new and improved musical pin apparatus embodying the principles and concepts of the present invention and generally designated by the reference numeral 10 will be described.

Figure 2:
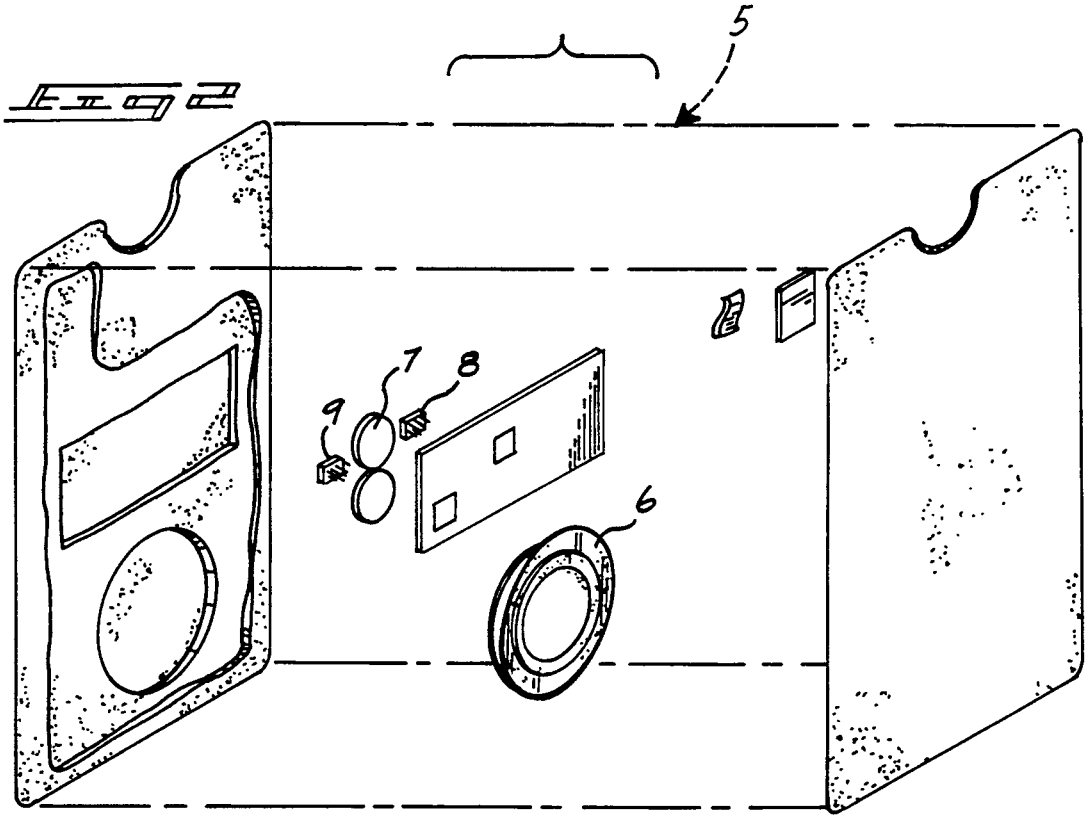
PRIOR ART Fig 2
FIG. 2 is an isometric illustration of a prior art structure employing IC structure.
Figure 3:
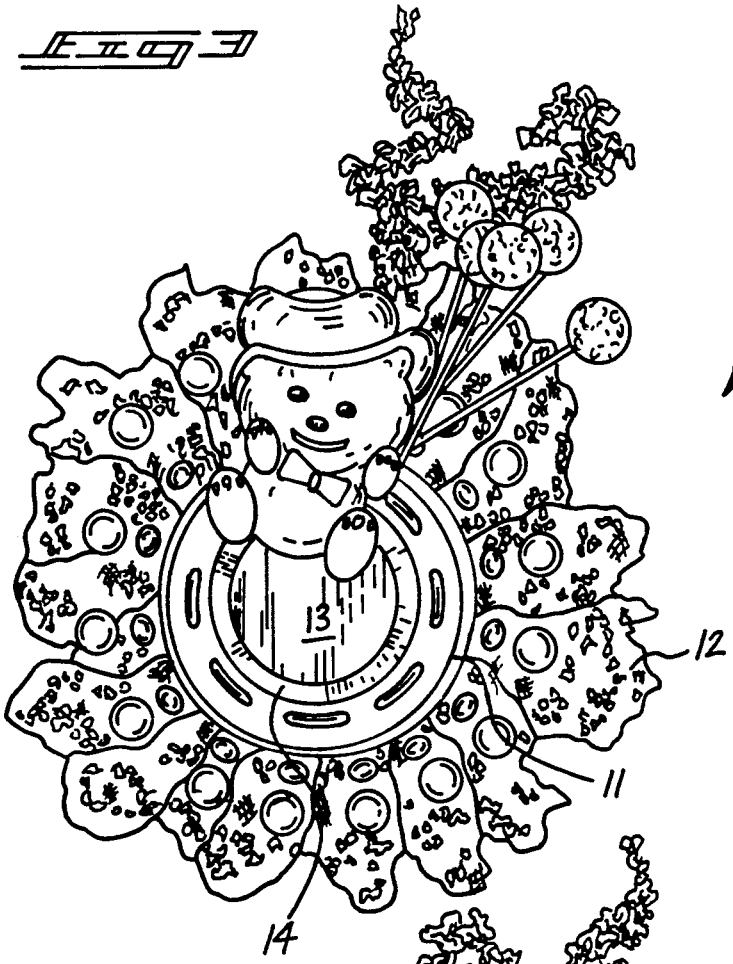
FIG. 3 is an orthographic frontal view taken in elevation of the instant invention.
Figure 4:
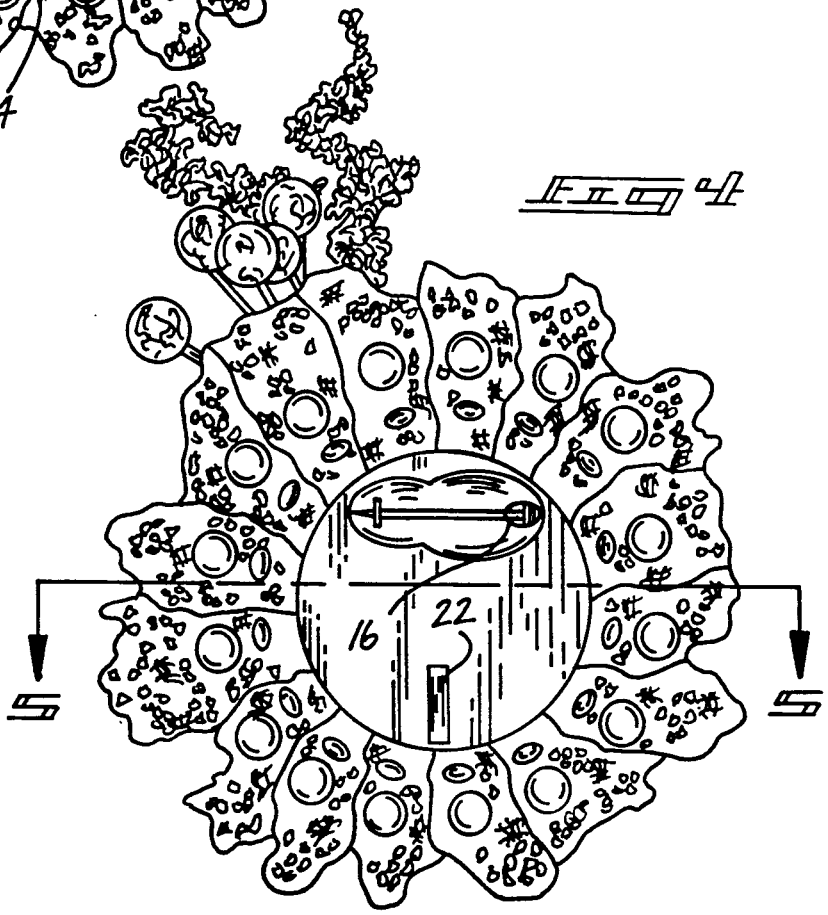
FIG. 4 is an orthographic rear view taken in elevation of the instant invention.
Figure 5:
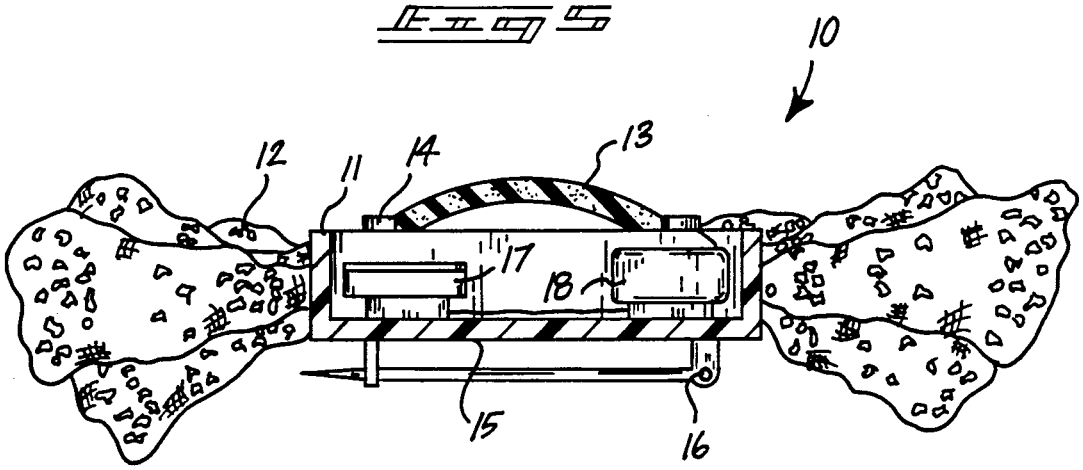
FIG. 5 is an orthographic view taken along the lines 5—5 of FIG. 4 in the direction indicated by the arrows.
Figure 6:
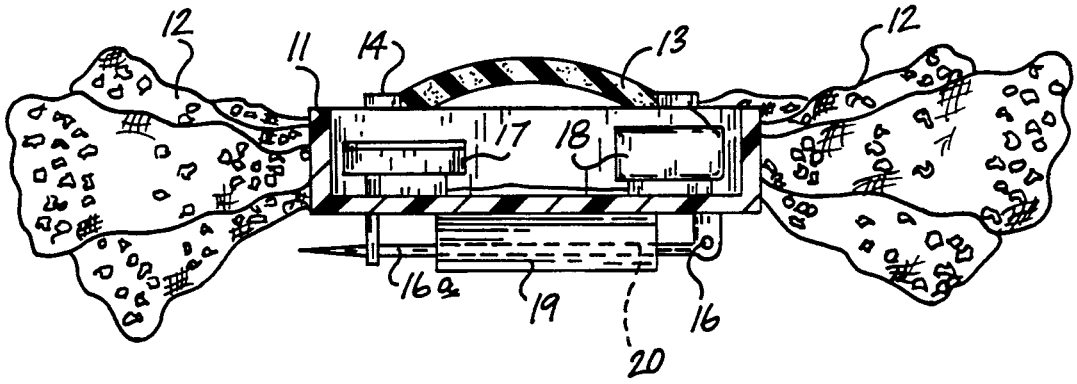
FIG. 6 is an orthographic cross-sectional illustration of the instant invention illustrating the mounting of a selectively securable magnetic cylinder to the latch structure.
Figure 7:
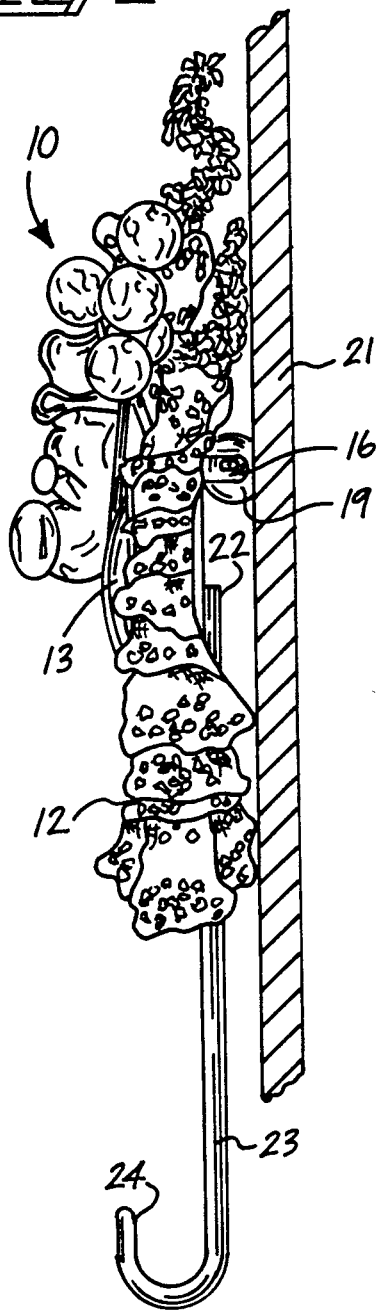
FIG. 7 is an orthographic side view taken in elevation of the instant invention mounted to a ferrous surface utilizing an optional hook structure thereon.
Figure 8:
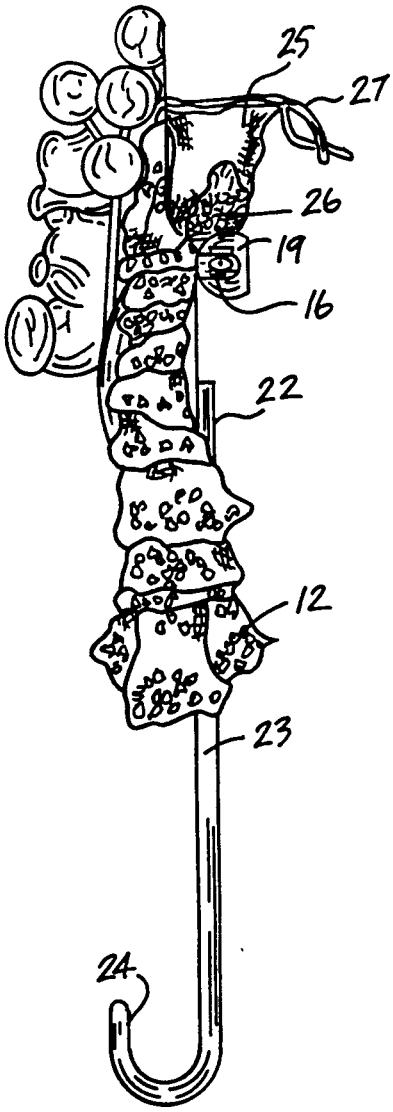
FIG. 8 is an orthographic side view taken in elevation of the instant invention with the inclusion of an odiferous supporting mesh pouch.

FIG. 1 illustrates a prior art musical structure 1 set forth as a greeting card wherein a first member 2 of the greeting card includes a musical box pre-contained within a cavity whereupon opening of the second portion 4 of the greeting card effects actuation of the musical box structure. FIG. 2 illustrates a prior art name card holder wherein an electrical circuit 8 cooperates with an integrated circuit 9 wherein electrical vocal reproduction means 6 cooperates with a power supply 7 to effect actuation of the musical IC unit whose circuitry in actuation is incorporated herein by reference in U.S. Pat. No. 4,866,865.

More specifically, the musical apparatus 10 of the instant invention essentially comprises a central annular housing 11 defining an internal cavity with a perimeter fabric network 12 in surrounding relationship relative to the annular side wall defined by the housing 11. A resilient convex dome start button 13 is mounted overlying the housing cavity and the housing cooperating with a switch ring 14 to provide selective actuation of a musical IC module 18 mounted fixedly within the housing and operative through a replaceable battery 17. The rear housing wall 15 includes a fastener pin structure 16 mounted thereon wherein the pin structure includes a pin shank 16*a*. The pin shank 16*a* permits selective securement to various clothing and garments. A ferro magnetic cylinder 19 is provided including a central cylinder bore 20 of a diameter substantially equal to a pin shank diameter defined by the pin shank 16*a* to permit sliding reception of the pin shank 16*a* within the cylinder bore 20..The ferro magnetic cylinder 19 permits selective securement of the apparatus to a ferro metallic support surface 21 such as a refrigerator or cabinetry and the like as conveniently available. A deformable support tube 22 is mounted to the rear housing wall 15 orthogonally arranged relative to the pin shank 16*a* to fixedly and frictionally receive a shank 23 of a hook 24. When the pin structure is mounted to the support surface 21 as illustrated, the hook 24 permits reception of various messages and the like thereon.

A mesh pouch 25 including a draw string 27 directed about an upper open end of the pouch 25 permits securement of an odiferous material 26 therewithin wherein the mesh porous pouch 25 permits aromatic permeation of the odiferous material throughout its surrounding environment and wherein the draw string 27 permits securement of the mesh pouch 25 through the fabric network 12 in securement of the mesh pouch to the organization.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A musical pin apparatus comprising in combination, a housing, the housing including an internal cavity, the internal cavity including a battery selectively mounted within the cavity and a musical integrated circuit module mounted within the cavity, and a switch ring in electrical association with the battery and integrated circuit module mounted to and overlying the housing cavity, and a camouflage fabric network mounted in surrounding relationship relative to the housing, and the housing including a rear housing wall, and fastener means mounted to the rear housing wall for selective securement of the housing to a plurality of selective supports, and wherein the fastener means includes a fastener pin structure, the fastener pin structure including a pin shank, the pin shank defined by a predetermined diameter, and a ferro magnetic cylinder selectively securable to the pin shank, the ferro magnetic cylinder including a cylindrical bore coaxially directed through the cylinder, the cylindrical bore defined by a predetermined bore diameter, the predetermined bore diameter substantially equal to the predetermined diameter to permit sliding securement of the ferro magnetic cylinder about the pin shank.

2. Apparatus as set forth in claim 1 wherein the switch ring includes a resilient convex dome overlying the switch ring to permit selective actuation and the pressing of the switch ring upon depressing of the convex dome.

3. Apparatus as set forth in claim 2 wherein the rear housing wall includes a deformable support tube, the deformable support tube orthogonally arranged relative to the pin shank, the deformable tube frictionally receiving and engaging a hook shank of a hook wherein the hook permits selective securement of various message components thereon.

4. Apparatus as set forth in claim 3 including a mesh porous pouch, the mesh porous pouch including an open upper end, the upper open end including a draw string directed therethrough, the draw string selectively securable through the fabric network to permit selective securement of the mesh pouch to the fabric network, and an odiferous material secured within the mesh pouch to permit aromatic permeation of the odiferous material throughout a surrounding environment.

* * * * *